United States Patent [19]

Gilmour et al.

[11] Patent Number: 5,034,292

[45] Date of Patent: Jul. 23, 1991

[54] METHOD OF THERMALLY FORMING IMAGES FROM METASTABLE METAL COLLOIDS

[75] Inventors: Hugh S. A. Gilmour, Rochester; David C. Shuman, Victor, both of N.Y.

[73] Assignee: Eastman Kodak Company, Rochester, N.Y.

[21] Appl. No.: 493,026

[22] Filed: Mar. 13, 1990

Related U.S. Application Data

[63] Continuation-in-part of Ser. No. 344,949, Apr. 28, 1989, abandoned.

[51] Int. Cl.[5] ..... G03C 5/56

[52] U.S. Cl. ..... 430/3; 430/292; 430/346; 430/495; 430/616; 430/964

[58] Field of Search ..... 430/616, 964, 346, 348, 430/198, 290, 292, 3; 346/76 L

[56] References Cited

U.S. PATENT DOCUMENTS

| | | | |
|---|---|---|---|
| 1,976,302 | 12/1930 | Sheppard et al. | 430/198 |
| 3,684,569 | 8/1972 | Milgram | 430/198 |
| 4,510,232 | 4/1985 | Gerber | 430/494 |
| 4,753,864 | 6/1988 | Bouldin et al. | 430/273 |

*Primary Examiner*—Charles L. Bowers, Jr.
*Assistant Examiner*—Mark R. Buscher
*Attorney, Agent, or Firm*—Oblon, Spivak, McClelland, Maier & Neustadt

[57] ABSTRACT

A method of forming visible images on a differentiated background comprises the application of thermal energy to a coating of metastable metal colloid on a support. Thermal energy is able to convert the metastable metal colloid to a stable spheroidal form. Computer control of a laser beam or thermal print head can be employed to provide highly resolved images carrying graphic, digital and textural information.

9 Claims, No Drawings

METHOD OF THERMALLY FORMING IMAGES FROM METASTABLE METAL COLLOIDS

This application is a continuation in part of U.S. Application Ser. No. 344,949, filed Apr. 28, 1989 abandoned.

BACKGROUND OF THE INVENTION

1. Field of the Invention

This invention is directed to a method for forming colored images on a differentiated background, by the application of thermal energy to an otherwise stable :coating of colloidal metastable metal particles.

2. Background of the Prior Art

In 1972, Defensive Publication T900,010 was published, describing the preparation of blue colloidal silver, having a relatively large particle diameter (about 300 A), which could be coated onto a surface, and immediately developed by the application of halide ions. Even the application of a skin surface, such as a fingertip, against the metastable silver particle coating is described as providing sufficient halide ions to form an image of the fingerprint.

However, formation of an image through the application of halide ions, using the unstable blue silver of the Defensive Publication, poses a number of obstacles and drawbacks. Thus, the resolution and sharpness of the image available using a halide ion is unsatisfactory for the provision of a yellow image having high density information and differentiation. Additionally, quantitative control of the halide ion, and application is a physically intensive process, that is not easily automated. Halide delivery from exposed and developed silver halide images involves controlled light exposure and a separate wet process. Given such impracticalities of image formation using a halide ion, the image formation process in Publication T900,010 is not practical for obtaining finely resolved images of commercial quality.

Accordingly, it remains an obJect of the art to provide a non photographic image formation system, which is capable of forming instant and stable highly resolved images on a differentiated colored background.

SUMMARY OF THE INVENTION

This invention is premised on the use of the metastable silver preparation disclosed in copending U.S. Pat. Application Ser. No. 344,950, filed in the name of Shuman. The entire disclosure of that application is incorporated herein by reference. Briefly, that application discloses the preparation of colored, metastable Group Ib metal particles. In a preferred embodiment, small dimensioned nuclei, under 20 nm in size, consisting of at least one noble metal, silver sulfide or nickel sulfide, with silver metal being particularly preferred, are employed. The nuclei are prepared in a hydrophilic polymer matrix, such as gelatin, and are plated with silver during an "amplification" process, by addition of a silver sulfite/borate solution to the particles. As plating continues, the silver plated tabular particles undergo a color change from yellow or orange to magenta to purple and ultimately to blue. These particles are stable at ambient conditions, and will not change color in the absence of the substantial presence of halide ions, or temperatures substantially above ambient temperatures, e.g., above about 100° C.

As disclosed in the referenced copending application, however, the application of thermal energy directly to the particles results in a recrystallization or shape change, resulting in a change in color, to the differentiated color corresponding to the stable spherical shape. The image, once formed, is stable, and is not altered in the absence of additional application of thermal energy.

Thus, a method for forming a visible image according to the invention comprises imagewise exposing a coating of a metal stable Group Ib metal colloid in a matrix on a support to thermal energy of sufficient intensity to form a stable image in those areas selectively exposed.

It has now been discovered that thermal energy can be used to prepare highly resolved colored images against a differential background. The thermal energy may be supplied by means of a thermal print head, laser, electronic flash or other concentratable light source, thermal input generator or ultrasonic generator. Relatively low (about 500 mJ/cm$^2$) thresholds of energy supplied from commercially available thermal print heads will form the image, instantly, without processing. Controlling these print heads with electronic circuitry enables the image to be formed entirely from computer input, allowing the formation of graphics and digital information on the same image or slide.

Other methods of applying thermal energy to the metastable silver coating disclosed herein will occur to those of ordinary skill in the art. It should be noted that the thermal energy must be applied in a directed manner to the silver coating, and that simply raising the ambient atmospheric temperature a few degrees will be insufficient to generate an image. Experiments indicate that a minimum application of energy of about 1.6 nanojoules per micron spot is necessary for complete yellow imaging, providing it is supplied in a short time interval of milliseconds or less. Longer times will require greater energy inputs to attain the required temperature for conversion.

Although, as noted, the image is stable on formation, it can be further stabilized, against subsequent thermal energy contact or change, by a variety of methods. Thus, laminating the exposed surface, or overcoating with a non reactive or chemically inactive protective transparent polymer, generally conventional in the art for the protection of, e.g., photographic images, an be employed.

Overcoats considered useful for protection against image degradation include gelatin, nitrocellulose, cellulose esters, cellulose ethers, polyvinylacetals, polyacrylamides, polyalkyl acrylates, polyvinylpyrrolidone, polyvinylimidazone, polycarbonates, polyvinylhalides; polyvinylidenehalides; ethylene-vinylacetate copolymers, polylactones, polylactams, and copolymers with monomeric units derived from styrene, acrylonitrile, vinyl alcohol, acrylic acid, and dibasic acids such as maleic and phthalic.

These overcoats may be applied by solvent coating, vacuum evaporation, film lamination, or any other technique known in the art. Pressure sensitive transparent tape may also be used.

As described above, thermal imaging with film composed of metastable colloidal silver can be accomplished by providing sufficient heat to significantly raise the temperature of the silver layer. If the heat is provided by a short duration Pulse from a diode laser, there will be a gaussian heat distribution of the spot or line from the laser. Thus, the edge of the line (spot) traced by the laser may not fully convert the silver colloid from blue to yellow. This edge is neither blue nor yellow, but some intermediate color. Subsequent exposures of this edge to the same laser prOdUCes no further conversion. This feature can be used advantageously to detect overwriting. If a second thermal exposure is applied over an existing recorded image, the second one appears to be below the first exposure when examined at high magnification. This property of metastable silver colloids provides a way of detecting alterations of legal documents. Security lines can be imposed on blank areas so that further additions to a document over the security lines are also detectable, insuring against unauthorized additions to a document. Since the recording media is non erasable, every form of alterations an be detected.

In another embodiment of the invention, if a layer of metastable colloidal silver is irradiated at close range with a xenon flash, a yellow "footprint' of the thermal source is imaged on the film. The size of the footprint will depend on the guide number of the flash unit, the design and size of the thyristor tube and lenses and the condition of the batteries. For a given manufacturer and model, a flash unit can be calibrated with blue silver film in terms of the size or area of the footprint generated for a properly functioning flash unit. Loss of output of a flash unit in question can be quantified by comparing the size of the yellow image it produces as compared with the size of a footprint of a standardized unit of the same manufacturer and model.

In still another embodiment of the invention, if the heat for a layer of metastable colloidal silver is provided by a short duration pulse from a xenon flash, some of the heat may dissipate to the surrounding environment by a conductive process. Differential heat dissipation from the imaging material can serve as the basis for generating a thermal fingerprint. If a finger is pressed in contact with a transparent film of metastable silver and is flashed from the backside with a xenon flash, the radiant heat generated causes the silver to switch from blue to yellow in the pore regions, but not in the regions corresponding with ridges of the skin which are in intimate contact with the film surface and which draw heat away from the imaging layer. An instant fingerprint is obtained in this manner. Any surface which is comprised of a thermally conductive material but which has a topography that provides regions of non contact (i.e., air gaps), can be imaged in the manner described above. An exposing device for fingerprinting the entire hemicylindrical surface of a finger consists of a transparent block with a curved surface on one face that can accommodate both the finger and film. An exposure is made uniformly from under the block.

As described above, sufficient heat must be applied to a layer of metastable silver to significantly raise the temperature of the silver layer. The temperature gradient required to raise the temperature of the silver layer above the point to cause color change can be lessened by applying uniform heat (below that temperature) to the film while exposing it to a thermal source such as a laser beam. Lowering of the temperature gradient in some manner, for example, by contacting the film with a heated drum, will result in less energy required from the imaging source (laser beam) to initiate a color change for imaging.

While thermal energy is normally used to change the color of the metastable metal colloid, chemical switching of blue metastable silver colloids to the yellow form can be accomplished by contacting the blue silver colloids with aqueous solutions of halide salts such as sodium chloride, providing the blue silver colloids are combined in a hydrophilic polymer layer that allows passage of halide ions. Since human saliva and sweat contain significant levels of chloride, these will convert the blue silver to its yellow form. This provides a means of transmitting a chemical image and recording topographical surfaces of the skin and lips onto the film. Thus, a fingerprint or lip print an be imaged onto blue silver films by simple contact. Blue silver can be passivated against chloride switching by treating the film with certain agents such as thiols, mercaptans, benzotriazoles, et. These agents can be used to stabilize finger and lip prints against subsequent inadvertent contact with chloride from dirt, dust, saliva and fingerprints, etc. Alternatively, passivating agents can be used to write onto blue silver. In this case, the image is invisible but can be revealed by immersing the film in a salt solution whereupon the concealed image shows up as blue against a yellow background.

In another embodiment of the chemical switching described above, if a water impermeable barrier layer is interposed between the silver layer and an aqueous halide salt solution, no color conversion of the blue silver will be observed. Sensitivity of blue silver to halides provides a simple means to test films, laquers, paints, etc., for water impermeability. These can be simply applied over a blue silver film and the overcoated film put in contact with a halide salt solution. Lack of protection is demonstrated if the underlying silver layer is converted from blue to yellow. In the same manner, lack of continuity (presence of pinholes) in the protective barrier layer can be detected.

DETAILED DESCRIPTION OF THE INVENTION

The formation of an image by the application of thermal energy to metastable metal colloid can be achieved using a wide variety of thermal energy sources. Due to the high degree of resolution available, a laser irradiation system is a preferred method for inputting thermal energy to the coating. The fact that laser irradiation can be easily controlled through computer monitoring makes such a system highly desirable, for the production of highly resolved, stable, instantly formed images having a high density of information of varied form, such as graphics, digital information, and bar codes.

Of course, as disclosed in the copending application of Shuman referred to above, the background color with metastable silver need not be blue. Any of a wide variety of colors, including orange, magenta, etc. can be achieved, by halting the amplification process employed in forming the metastable silver at an early stage. As also disclosed in the copending Shuman application, images may be formed from other Group Ib metals, such as metastable gold and copper. Research to date indicates that the blue field images with silver are the clearest and most easily read, and therefore constitute a preferred form of the invention.

This invention can be further understood by reference to the examples set forth below.

EXAMPLE 1

This example describes the preparation and use of a coating of a metastable silver for thermal imaging using a laser system.

The blue silver colloid was prepared as described in Example 1 of the copending application of Shuman.

The nuclei are prepared as follows.

Deionized gelatin (3.5 g) was dissolved in distilled water (350 ml). Potassium borohydride (0.18 g) was added with stirring and the solution was heated to 40° C. A solution of silver nitrate (0.35 g) in distilled water (100 ml) was added rapidly in one portion with vigorous stirring. This mixture was then added with stirring to a deionized gelatin in water solution (7.7 g/500 ml). Additional water was added to adjust the weight (to 1.0 kg), and the mixture was cooled below 0° C. for chill setting. The resulting dispersion of nuclei 5–7 nm in diameter was pressed through a 50 mesh stainless steel screen to produce gelatin particles about 280 micrometers in diameter. To prevent the gelatin from agglutinizing into large clumps, the dispersion was further diluted with twice its weight in water.

The amplification process is described below:

A solution of silver nitrate (0.60 g in 50 mL distilled water) was added with stirring to a solution (500 mL) of anhydrous sodium sulfite (1.2 g), sodium tetraborate decahydrate (5.0 g), and calcium acetate monohydrate (0.025 g) and then cooled to 15° C.

To a portion of the previously prepared nuclei dispersion (150 g) chilled to 10° C., a solution of potassium hydroquinone monosulfonate (1.14 g/200 mL) was added with stirring and cooling. This solution was added with moderate stirring to the cooled "silver nitrate sulfite borate" solution at 15° C., diluted to 1000 mL with distilled water, and adjusted to pH 9.37 with dilute nitric acid or sodium hydroxide.

During this amplification the particles undergo a color change from yellow to orange to magenta to purple to blue. The reaction may be quenched at a given time to produce a metastable silver of a given hue., blue particles were specifically produced by pouring the slurry into 1.5 l of distilled water at 10° C after 6 minutes. The silver sol particles were collected by passage of the slurry through a fine mesh nylon dispersion bag, then redispersed in 3.0 l distilled water at 10° C. After being stirred occasionally for 10 minutes, the particles were again collected in a nylon mesh bag, immediately melted, and filtered through Whatman No. 2 paper.

The blue metastable silver produced by the above preparation was essentially triangular tabular in form with edge length of approximately 20 nanometers and about 6 nanometers in thickness with an average mass approximately that of Carey Lea silver.

On a 175 μm thick polyethylene terephthalate support a subbing layer of deionized photographic bone gelatin (6.5 g/m$^2$) and bis(vinylsulfonyl)methane (0.34 g/m$^2$) was coated. On top of this layer the blue silver sol (0.27 g/m$^2$) in deionized photographic bone gelatin described above (1.1 g/m$^2$) was coated.

The silver coating was exposed on a laser scanning device equipped with a Spectrodiode Laboratories Laser Model SDL 24200H2. The coating was taped face down on a 294 mm circumference drum with pressure sensitive tape. A sheet of 175 μm poly(ethyleneterephthalate) containing titanium dioxide and overcoated with Bayer AG:Makrolon® 5705 (a bisphenol A polycarbonate resin) at 4.0 g/m$^2$ was placed between the drum and the silver sol coated layer. The drum was rotated at 120 rpm and the silver sol coated layer was scanned with a focused 40 μm spot diameter of the 830 nm laser beam. The power was 250 milliwatts (1.4 Joule/cm$^2$) with a 30 μm pitch of the raster scan. The laser exposure apparatus was controlled by a computer program for generation of raster scan images.

Unexposed areas (Dmin) remained blue, while fully exposed areas (Dmax) were converted to yellow. By varying the power to the laser from 70 to 200 milliwatts, the power delivered per unit area was varied to produce a stepped image. The image consists of closely spaced exposed and unexposed lines. Status A blue densities observed are tabulated below.

| | Blue Density |
|---|---|
| Step 1 (Dmin - no exposure) | 1.3 |
| Step 3 | 1.5 |
| Step 6 | 2.0 |
| Step 9 | 2.1 |
| Step 12 (Dmax - full exposure) | 2.2 |

Images of text and graphs were also created.

In a series of related experiments using metastable silver colloid coatings of other hue, such as burgundy, magenta, cyan, or neutral, images were formed by conversion to the same yellow colloidal silver in full exposure areas. The preparation of metastable silver colloids other than blue in color is described in Example 2 of the copending application of Shuman.

EXAMPLE 2

This example is similar to Example 1 but describes imaging using a xenon electronic flash lamp.

The metastable silver colloid coating was prepared as described in Example 1.

A Vivitar Model 283 Electronic Flash Unit with an output of 2900 beam candle power seconds at 5500° K. and a flash duration of one millisecond was placed with the phototube housing 2 mm above the silver sol coating. A carbon particle graduated density object was placed between the electronic flash and the coated silver layer. A single flash produced a yellow area where the flash intensity was the highest (clear area of the test obJect); background color remained in areas of no exposure (high density areas of the test obJect).

This experiment may appear to be imaging by light. However, it is thermal imaging. The coating was exposed for 4 hours in the gate of a Kodak Ektagraphic® III AMT, 35 mm slide projector equipped with a 300 watt Type EXR proJection lamp. In exposed areas the blue density increased by only 0.1 density units, and the sample did not appear yellow in color.

A separate sample was placed on the stage of an Olympus Model BH 2 Optical Microscope which contained a 100 watt focussed light source. Exposure for 30 seconds to full intensity of the focussed light supplied sufficient thermal energy to convert the area to yellow. The temperature was high enough to also distort the polyethylene terephthalate support.

A separate sample was placed up in the chamber of a Mettler Model FP 5 microscope hot stage which had been preset to a temperature of 190°. Within ten seconds, the blue density increased by 1.8 density units.

EXAMPLE 3

This example is similar to Example 1 but describes imaging using ultrasonic energy as the thermal source.

The metastable silver colloid coating was prepared as described in Example 1. The silver colloid coating was placed face up under a Dukane Ultrasonic Welder, equipped with a Model 40A 321B, 1000 watt power supply. A piece of subbed poly(ethyleneterephthalate), as in Example 1 was placed over the sample gelatin layer to gelatin layer so as to protect against abrasion. The horn was lowered to press the composite sample against a steel anvil. The contact area of the horn with the top of the support was 5 mm by 3 mm. Power was supplied for 50 milliseconds and the horn remained in contact with the sample for 1 second. There was now a yellow area which reproduced the shape of the contact area of the horn, and the top pipe of the film support was welded to the sample in this same area. Microdensitometer measurements of the unchanged blue and the converted yellow areas confirmed the visual observations: the Status A red and green microdensitometer readings decreased by 1.5 density units, and the blue increased by 0.8 density units.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the U.S. is:

1. A method for forming a visible image, comprising imagewise exposing a coating of a metastable colloid to thermal energy of sufficient intensity to form a stable image in those areas selectively exposed, said metastable colloid comprising tabular particles dispersed in a matrix, said particles consisting of nuclei of metal compounds selected from the group consisting of noble metals, silver sulfide and nickel sulfide, said nuclei being less than 20 nanometers in diameter and electrolessly plated with silver.

2. The method of claim 1, wherein said nuclei metal is silver.

3. The method of claim 2, wherein said unexposed areas of metastable colloid appear blue.

4. The method of claim 1, wherein said imagewise exposure of said colloid to thermal energy is achieved by irradiating said coating with a directed laser beam.

5. The method of claim 1, wherein said exposure to thermal energy is achieved by exposing said coating to a non-directed, high intensity flash.

6. The method of claim 5, wherein imaging is achieved by interposing an object differentially restricting the transmission of thermal energy from said high intensity flash, whereby said object corresponds to non imaged areas.

7. The method of claim 1, wherein said exposure to thermal energy is achieved by applying ultrasonic energy to said coating.

8. The method of claim 1, wherein said image is further stabilized by laminating an overcoat on said image.

9. The method of claim 1, wherein said image is further stabilized by forming a polymer film over said coating.

* * * * *